US006397527B1

(12) United States Patent
Pellock

(10) Patent No.: US 6,397,527 B1
(45) Date of Patent: Jun. 4, 2002

(54) ROOF BRACING AND BRACED ROOF STRUCTURES

(75) Inventor: Michael A. Pellock, Edwardsville, IL (US)

(73) Assignee: Mitek Holdings, Inc., Wilmington, DE (US)

( * ) Notice: Subject to any disclaimer, the term of this patent is extended or adjusted under 35 U.S.C. 154(b) by 0 days.

(21) Appl. No.: 09/681,151

(22) Filed: Jan. 29, 2001

(51) Int. Cl.[7] ..... E04B 7/02; E04C 3/40

(52) U.S. Cl. ..... 52/90.1; 52/640; 52/643; 52/712; 52/282.1

(58) Field of Search ..... 52/712, 713, 643, 52/645, 646, 653.1, 657, 90.1, 696, 640, 282.1, 276, 278, 279

(56) References Cited

U.S. PATENT DOCUMENTS

| | | | | | |
|---|---|---|---|---|---|
| 843,212 | A | | 2/1907 | Holt | |
| 1,062,994 | A | * | 5/1913 | Pruden | 52/91.1 X |
| 1,765,121 | A | * | 6/1930 | Audet | 52/282.1 |
| 2,427,021 | A | * | 9/1947 | Rapp | 52/96 X |
| 2,659,323 | A | * | 11/1953 | Alvarez, Jr. | 52/409 X |
| 2,722,901 | A | * | 11/1955 | Johnson et al. | 52/91.1 |
| 3,127,960 | A | * | 4/1964 | Smith et al. | 52/90.1 X |
| 3,135,070 | A | * | 6/1964 | Waring et al. | 52/90.1 X |
| 3,232,020 | A | * | 2/1966 | Gillis | 52/409 |
| 4,015,374 | A | * | 4/1977 | Epstein et al. | 52/57 |
| 5,212,913 | A | * | 5/1993 | Whitehead | 52/57 |
| D414,400 | S | | 9/1999 | Williams | |
| D419,430 | S | | 1/2000 | Williams | |
| 6,138,425 | A | * | 10/2000 | Wendt | 52/712 X |
| 6,254,306 | B1 | | 7/2001 | Williams | |

FOREIGN PATENT DOCUMENTS

| | | | | |
|---|---|---|---|---|
| CA | 975128 | * | 9/1975 | 52/90.1 |
| GB | 581703 | * | 10/1946 | 52/90.1 |
| GB | 2214538 | * | 9/1989 | 52/90.1 |
| JP | 4-70449 | * | 3/1992 | 52/90.1 |

* cited by examiner

*Primary Examiner*—Laura A. Callo
(74) *Attorney, Agent, or Firm*—Senniger, Powers, Leavitt & Roedel

(57) ABSTRACT

Roof bracing, and a braced roof structure including the bracing located at the junction of dihedral surfaces of the roof structure which meet at a dihedral angle determined by trusses in a roof framing system. The bracing includes a pair of elongate braces each having a web and a flange extending from an edge of the flange. The web is bendable relative to the flange. The braces can be applied with their flanges in back-to-back engagement and with the webs extending laterally outwardly generally at the dihedral angle for generally flatwise engagement of the webs with the trusses. The braces also function as beams to support the roofing against upward and downward loads on the roofing.

16 Claims, 7 Drawing Sheets

ROOF BRACING AND BRACED ROOF STRUCTURES

BACKGROUND OF THE INVENTION

This invention relates to roof bracing and roof structures incorporating said bracing, more particularly to bracing for trussed roofs and trussed roof structure incorporating said bracing.

The invention is especially directed to bracing for the junction of two dihedral roof surfaces meeting at a dihedral angle determined by trusses in a roof framing system, such as bracing for a ridge of a ridged roof structure (including a hip of a hipped roof structure) and a valley of a valleyed roof structure, and to roof structure such as ridged, hipped or valleyed structure incorporating said bracing.

The invention is also directed to a trussed roof structure incorporating the bracing which provides support for the roofing laid on the trusses.

BRIEF SUMMARY OF THE INVENTION

Among the several objects of this invention may be noted the provision of bracing for the junction of two dihedral roof surfaces, such as the junction at a ridge of a ridged roof structure (including a hip of a hipped roof structure) or the valley of a valleyed roof structure, adapted for application to different roof structures having dihedral roof surfaces at different dihedral angles; the provision of such bracing which is not only economical to manufacture but economical to adapt for application to said different roof structures and to apply in the field; and the provision of trussed roof structures having dihedral roof surfaces with bracing for strengthening the junction of such surfaces and supporting the roofing.

In general, bracing of this invention is for application extending lengthwise of the junction of two dihedral roof surfaces where they meet at a dihedral angle determined by trusses in a roof framing system, said bracing comprising a pair of elongate braces each comprising a strip of sheet metal formed to have a longitudinally extending web and a flange extending from the web at a longitudinally extending edge of the web, the flange and web of each brace meeting at said edge at a predetermined angle, the web being bendable at said edge to different angles relative to the flange, said braces being applicable to said junction with the flanges in back-to-back engagement and with the webs extending laterally outward generally at said dihedral angle for generally flatwise engagement of the webs with said trusses and securement of the webs to the trusses.

A roof of the invention has a framing system comprising trusses meeting at a junction, the trusses determining two dihedral roof surfaces meeting at a dihedral angle at said junction, with bracing extending lengthwise of the junction comprising a pair of elongate braces each comprising a strip of sheet metal formed to comprise a longitudinally extending web and a flange extending from the web at a longitudinally extending edge of the web, said braces extending lengthwise of said junction with the flanges thereof in back-to-back engagement and with the webs extending laterally outward generally at said dihedral angle generally in flatwise engagement with and fastened to said trusses, and roofing on the trusses extending over the webs.

Other objects and features will be in part apparent and in part pointed out hereinafter.

BRIEF DESCRIPTION OF THE SEVERAL VIEWS OF THE DRAWINGS

Corresponding reference characters indicate corresponding parts throughout the several views of the drawings.

DETAILED DESCRIPTION OF THE INVENTION

Figure 1:
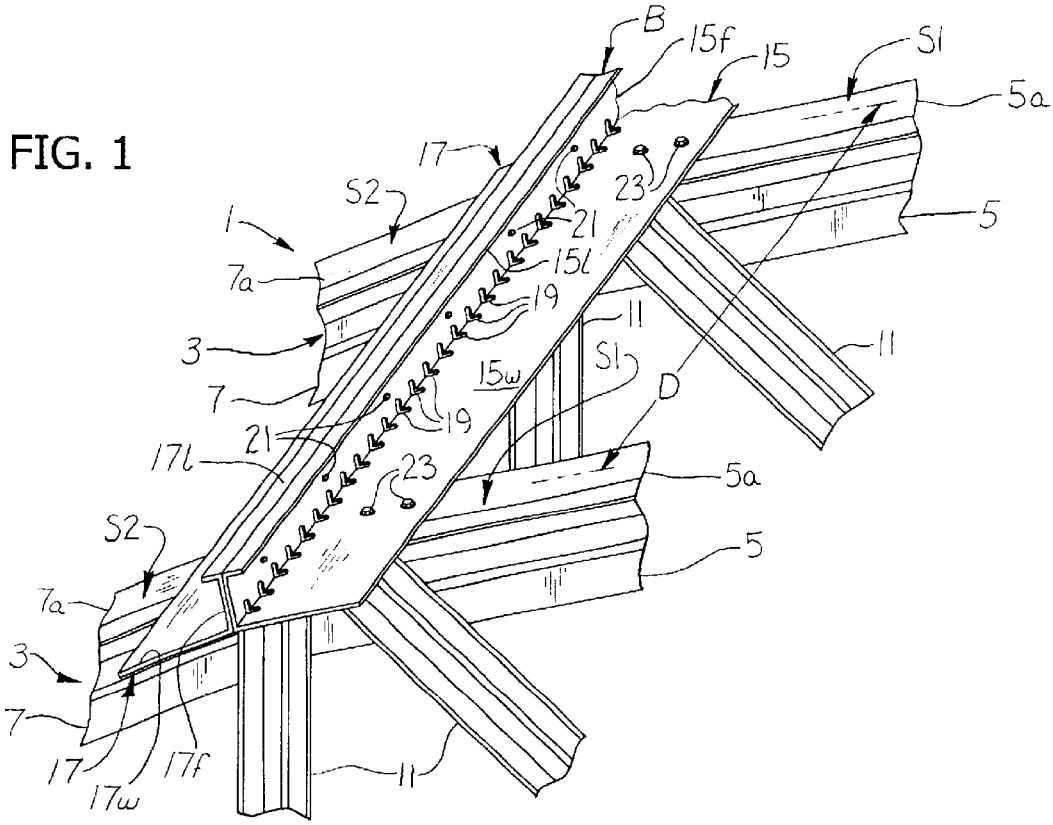
FIG. 1 is a semi-diagrammatic perspective of a fragment of a roof framing system with bracing of this invention applied to a ridge established by trusses of the system.
Figure 2:
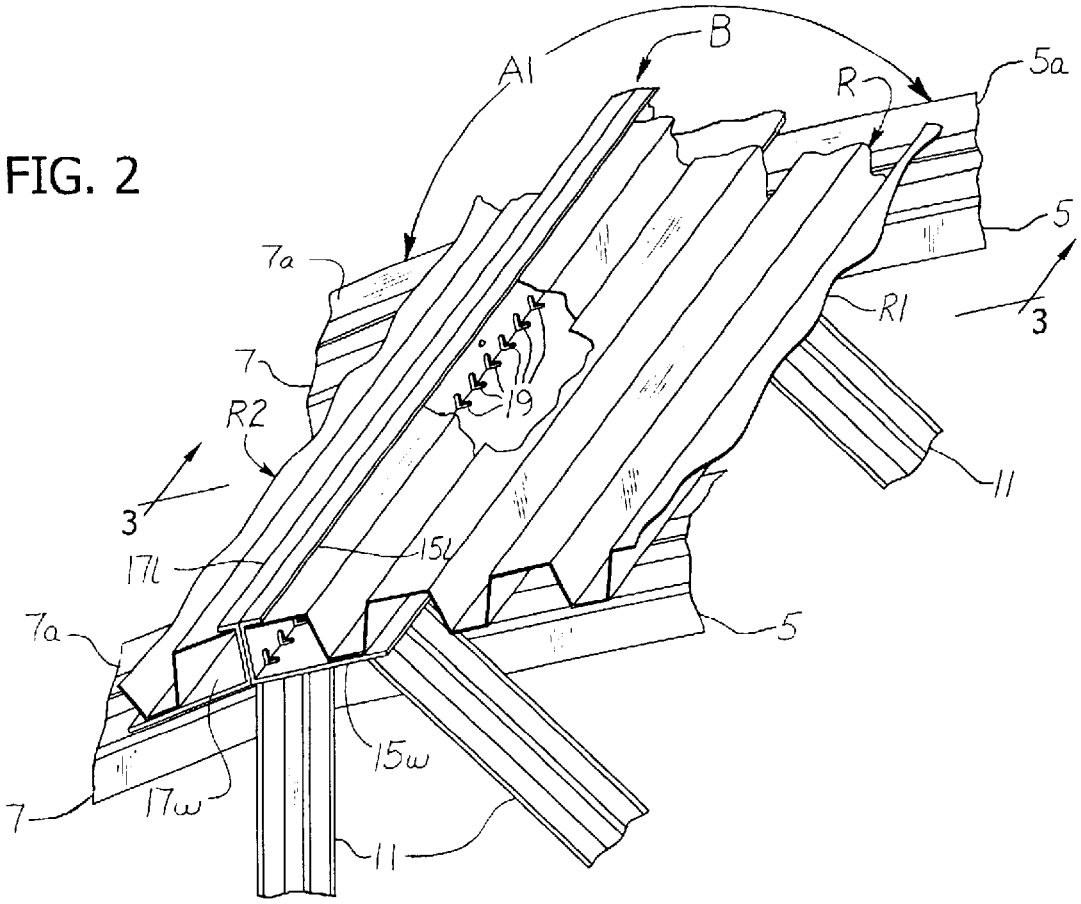
FIG. 2 is a development of FIG. 1, partly broken away, showing the addition of corrugated sheet metal roofing thereto completing the roof.
Figure 3:
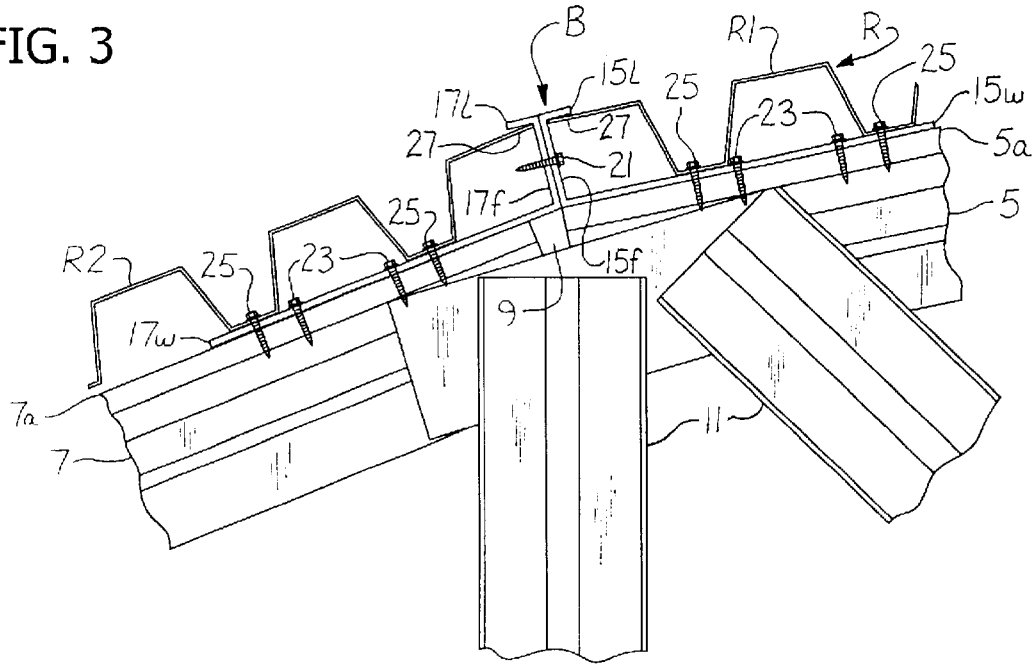
FIG. 3 is a view generally in section on line 3—3 of FIG. 2.
Figure 5:
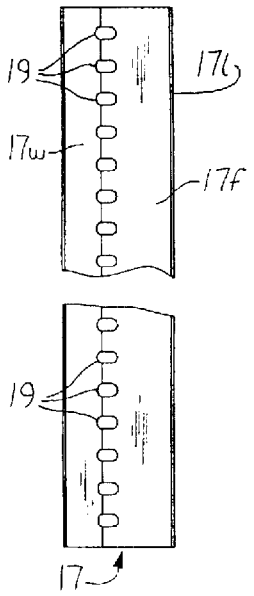
FIGS. 5 and 6 are left and right side views, respectively, of FIG. 4, each partly broken away.
Figure 4:
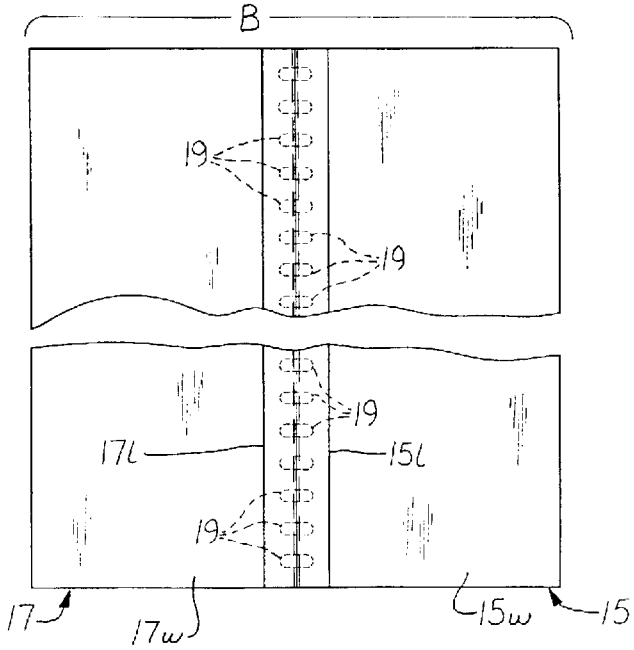
FIG. 4 is a plan, partly broken away, of the bracing per se.
Figure 6:
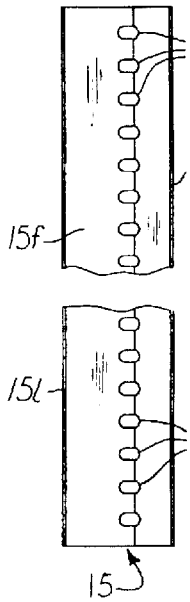
Figure 7:
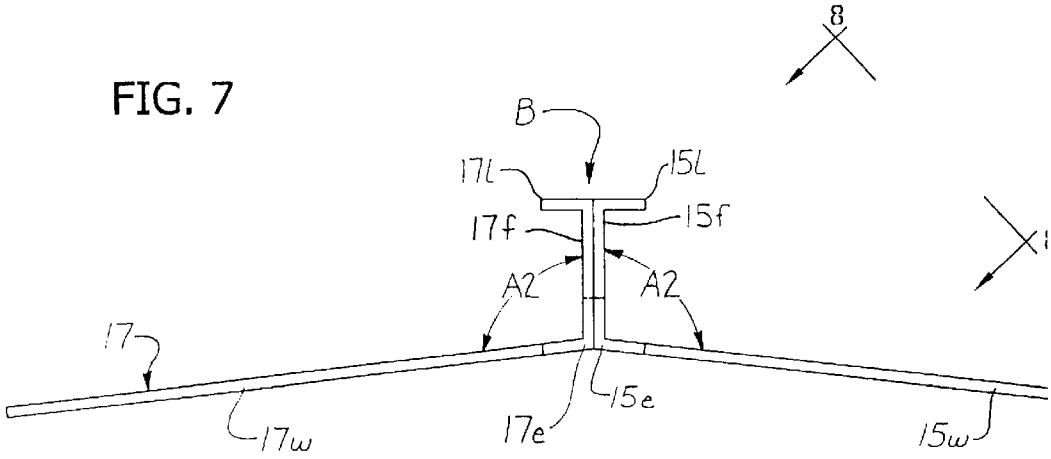
FIG. 7 is an enlarged end view of FIG. 4.
Figure 8:
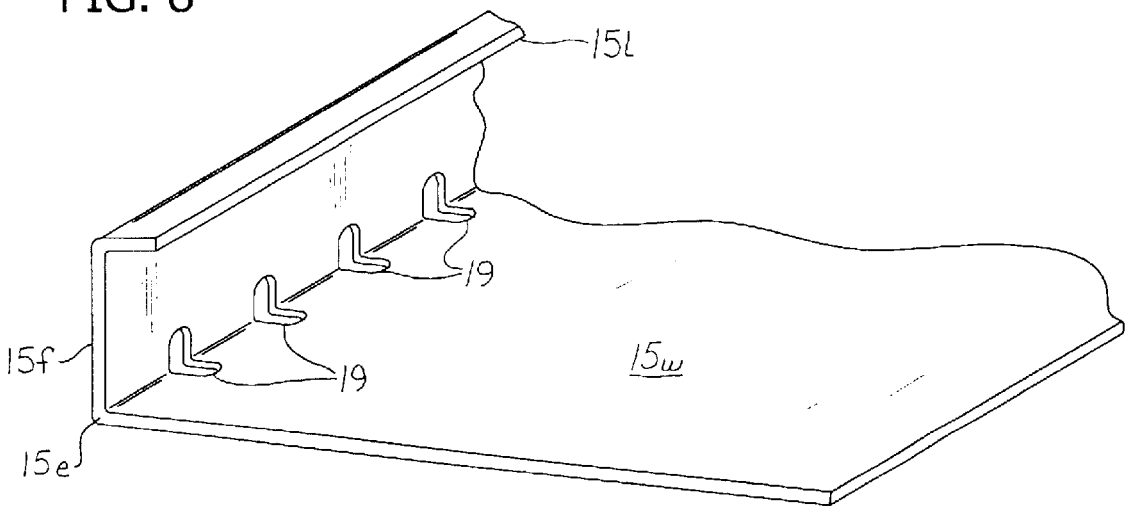
FIG. 8 is a fragmentary perspective as viewed generally on line 8—8 of FIG. 7.

Referring first to FIGS. 1–3, there is illustrated part of a roof structure, generally designated 1, comprising roof trusses 3 (only two being shown) extending parallel to one another in a roof framing system, the trusses being spaced a distance indicated at D (for example four feet). As illustrated, each truss 3 is one of conventional format having a top chord comprising upper members sloping upward to an apex peak (not shown) and inclined end members each slanting down from the junction with the ends of the upper members to the respective heels (not shown) of the trusses, and web members triangulating the space between the top and bottom chords. The upper chord member of each of the trusses shown in FIGS. 1–3 is designated 5, the end member of each of the trusses shown in FIGS. 1–3 is designated 7, and the junction thereof is designated 9 (FIG. 3). The web members shown in FIGS. 1–3 are each designated 11. The invention is especially applicable, though not limited in application, to roof structure wherein each truss 3 is a metal truss, the chords and webs of each truss being formed of sheet metal with the cross-section shown, the upper chord members 5 having top flanges 5*a* and the chord end members 7 having top flanges 7*a*. The trusses illustrated in FIGS. 1–3 are each of the type sold under the trade name ULTRA-SPANÂ® by Mitek Industries, Inc. of Chesterfield, Mo. (assignee of this invention). It is to be understood that the present invention (described below) is applicable to trusses of other types, including trusses made partially or exclusively of wood.

As shown, the trusses 3 establish two dihedral roof surfaces indicated at S1 and S2 meeting at a dihedral angle determined by the angle between the upper chord member 5 and the inclined end chord member 7, this angle being the angle indicated at A1 in FIG. 1. The roof surface S1 is presented by the upwardly facing surface of the flanges 5*a* of the upper chord members 5 and the roof surface S2 is presented by the upwardly facing surfaces of the flanges 7*a* of the end chord members 7. Surface S2 may slope upwardly toward the top as shown in FIG. 1. Bracing of this invention, designated in its entirety by the reference character B, extends lengthwise of the junction at 9 of the two dihedral surfaces where they meet at angle A1 (see FIG. 2) in the roof framing system, thus bracing the ridge presented by the trusses at 9.

Bracing B, shown in FIGS. 4–8 as supplied for the application in the field extending lengthwise of the junction 9 of roof surfaces S1 and S2, comprises a pair of elongate braces, one designated in its entirety by the reference numeral 15 and the other designated in its entirety by the reference numeral 17. Each brace 15, 17 comprises a strip of sheet metal such as 16 gauge sheet steel (0.057 inch thick) formed in a suitable bending operation to comprise a longitudinally extending flat web and a flat flange extending from the web at a longitudinally extending edge of the web (a bend), with a lip on the flange (on the free edge of the flange extending over the web). The cross-section of one brace is a mirror image of the cross-section of the other. The web, flange and lip of the brace 15 are indicated 15*w*, 15*f*, and 15*l*, respectively, similarly the web, flange and lip of the brace 17 are indicated at 17*w*, 17*f* and 17*l*, respectively. The stated edge (bend) of brace 15 is indicated at 15*e*; similarly the stated edge (bend) of brace 17 is indicated at 17*e*. The web 15*w*, 17*w* of each brace is considerably wider than the respective flange 15*f*, 17*f*.

The flange and web of each brace 15, 17 as supplied for the application in the field, meet at the respective edge 15*e*, 17*e* at a predetermined meeting angle A2 which may range from about 10° to 30°, specifically 15° as shown. Each web 15*w*, 17*w* is bendable in the field at the respective edge 15*e*, 17*e* to different angles relative to the respective flange 15*f*, 17*f* so that the braces 15, 17 are applicable to the stated junction 9 (the ridge as shown in FIGS. 1–3) with the flanges 15*f*, 17*f* in back-to-back engagement and with the webs 15*w*, 17*w* extending laterally outward from the flanges 15*f*, 17*f* angled to correspond generally to the stated dihedral angle A1 (i.e. with A2+A2=A1) for generally flatwise engagement of the webs 15*w*, 17*w* with the trusses 3 (more specifically with the top flanges 5*a*, 7*a* of the upper chord members 5, 7 of the trusses) and securement of the webs 15*w*, 17*w* to the trusses.

To facilitate the bending in the field of the webs 15*w*, 17*w* to the different angles relating to the flanges 15*f*, 17*f* as may be needed, each brace 15, 17 is weakened along the edge 15*e*, 17*e* thereof. Preferably, this weakening of each brace 15, 17 is accomplished by providing each brace 15, 17 with a series of holes 19 spaced at intervals along the edge 15*e*, 17*e* thereof; e.g. for braces with the web 15*w*, 17*w* four inches wide and the flanges 15*f*, 17*f* one and one/eighth inches high, holes about one-quarter inch wide spaced at intervals of about three-quarters inch are provided.

As shown in FIGS. 1–3, the braces 15, 17 are applied to the trusses extending lengthwise on the junction 9 (the ridge defined the trusses), one or both of the webs 15*w*, 17*w* being bent by hand on the job to extend outward from the flanges 15*f*, 17*f* generally at the angle relative to one another equal to dihedral angle A1 of the roof surfaces S1, S2, being applied with the flanges 15*f*, 17*f* in back-to-back engagement and the webs 15*w*, 17*w* in flatwise engagement with the trusses 3, more specifically in flatwise engagement with the top flanges 5*a*, 7*a* of truss members 5, 7. It is to be understood that the bracing may be formed as a single piece without departing from the scope of the present invention. The flanges 15*f*, 17*f* are secured together in said back-to-back engagement by fasteners 21, such as self-tapping screws, spaced along the flanges at 24 inch or less inch intervals, for example, and the webs 15*w*, 17*w* are secured to the flanges 5*a*, 7*a* of chord members 5, 7 of the trusses 3 by fasteners 23 such as self-tapping screws (two screws 23 per flange 5*a*, 7*a* per truss, for example). The flanges 15*f*, 17*f* extend generally upwardly from the webs 15*w*, 17*w* along the ridge at 9, being stiffened by the lips 15*l*, 17*l* at their free upper edges, lying in a plane which preferably generally bisects the dihedral angle of the roof surfaces S1, S2 (and the dihedral angle of the webs 15*w*, 17*w*).

With the bracing B (braces 15 and 17) so applied and fastened down, roofing R (FIGS. 2 and 3) is applied to the trusses 3 on roofing surfaces S1 and S2, the roofing extending over the webs 15*w*, 17*w* and being secured thereto. As shown, the roofing is corrugated sheet metal roofing, a section R1 thereof being applied on surface S1 presented by flanges 5*a* of the upper chord end members 5 and another section R2 being applied on surface S2 presented by flanges 7*a* of the chord end members 7. Areas of the corrugated sheet metal roofing sections R1, R2 lie flatwise on webs 15*w*, 17*w* of the braces 15, 17 and valleys of the roofing sections in those areas are fastened on the webs as by self-tapping screws 25. Valleys of the corrugated roofing sections R1, R2 in other areas are fastened on the flanges 5*a*, 7*a* of the truss members as by self-tapping screws (not shown). Marginal portions of the roofing sections R1, R2 indicated at 27 extend under the lips 15*l*, 17*l* of the braces (see particularly FIG. 3).

Figure 9:
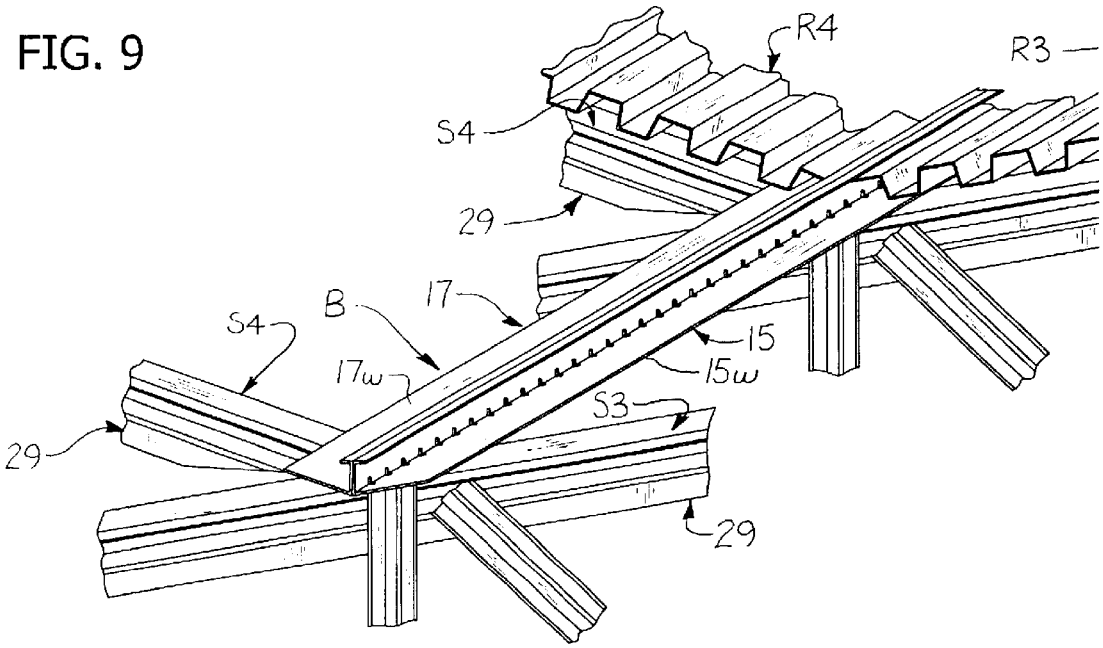
FIG. 9 is a semi-diagrammatic perspective of a modification wherein the roof is a valleyed roof and the bracing is applied to a junction in a valley.

FIG. 9 illustrates the application of the bracing B in a valley of a valleyed roof structure of two dihedral roof surfaces S3 and S4 presented by trusses such as indicated at 29. Webs 15*w*, 17*w* of braces 15, 17 of the bracing are bent at edges 15*e*, 17*e* thereof to extend laterally slanting upwardly in this instance at the dihedral angle of the surfaces S3, S4. Roofing sections R3 and R4, of corrugated sheet metal, are applied to surfaces S3 and S4, and the same type of fastening as described above for the ridged roof structure is provided securing webs 15*w*, 17*w* to the trusses and the roofing sections in place.

Wherever the braces 15, 17 are placed, the webs 15*w*, 17*w* underlie and provide support for the roofing sections R1, R2 lying on the webs. The webs 15*w*, 17*w* are located under edge margins of the roofing sections R1, R2 and extend along their entire lengths, providing support and rigidity for the entire roofing section. The configuration of each brace 15, 17 permits it to provide substantial support for upward and downward loads applied to the roofing sections R1, R2. More particularly, the flanges 15*f*, 17*f* provide resistance to bending of the braces 15, 17 about axes parallel to the roof surfaces S3 and S4, providing more strength to resist such bending over conventional one piece, flat plates bent to a "V" corresponding to the angle of the inserting roof surfaces to support the edge margins of adjacent roofing sections (not shown). The lips 15*l*, 17*l* also provide substantial resistance to bending of the braces 15, 17. Thus, it may be seen that the brace B functions as a beam to support the roofing sections R1, R2.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. Bracing for application extending lengthwise of the junction of two dihedral roof surfaces where they meet at a dihedral angle determined by trusses in a roof framing system, said bracing comprising a pair of elongate braces each comprising a strip of about 16 gauge sheet metal formed to comprise a longitudinally extending web and a flange extending from the web at a longitudinally extending edge of the web, the flange and web of each brace meeting at said edge at a predetermined angle, the web being bendable in the field at said edge to different angles relative to the flange, wherein each brace is formed with a lip on the free edge of its flange extending over the web of the brace and stiffening the brace, said bracing being adapted for receiving roofing sections and providing support and rigidity against loads applied to such roofing sections, wherein each brace is weakened along the meeting edge of the web and flange to facilitate bending of the web in the field to different angles relative to the flange thereof, said braces being applicable to said junction with the flanges in back-to-back engagement and with the webs extending laterally outward generally at said dihedral angle for generally flatwise engagement of the webs with said trusses and securement of the webs to the trusses.

2. Bracing as set forth in claim 1 wherein each brace is weakened by having a series of holes therein along its said edge.

3. Bracing as set forth in claim 1 wherein the web of each brace is wider than the flange of the brace.

4. Bracing as set forth in claim 3 wherein said predetermined meeting angle of the flange and web of each brace is in the range from about 10° to about 30°.

5. Bracing as set forth in claim 4 wherein each brace is weakened by having a series of holes therein spaced at intervals along the meeting edge of the web and flange thereof.

6. A roof having a framing system comprising trusses meeting at a junction, the trusses determining two dihedral roof surfaces meeting at a dihedral angle at said junction, bracing extending lengthwise of the junction and being adapted for receiving roofing sections and providing support and rigidity against loads applied to such roofing sections comprising a pair of elongate braces each comprising a strip of sheet metal formed to comprise a longitudinally extending web and a flange extending from the web at a longitudinally extending edge of the web, wherein the braces each comprise a lip extending from the flange at a longitudinally extending edge of the flange opposite the web and stiffening the brace, said braces extending lengthwise of said junction with the flanges thereof in back-to-back engagement and with the webs extending laterally outward generally at said dihedral angle generally in flatwise engagement with and fastened to said trusses, and roofing on the trusses extending over the webs.

7. A roof as set forth in claim 6 wherein the junction is a ridge.

8. A roof as set forth in claim 6 wherein the junction is a valley.

9. A roof as set forth in claim 6 wherein the flanges are secured together in said back-to-back engagement.

10. A roof as set forth in claim 9 wherein the flanges are fastened together by self-tapping screws.

11. A roof as set forth in claim 9 wherein the flanges are fastened together in said back-to-back engagement by self-tapping screws, the trusses are sheet metal trusses, and the webs are fastened to the trusses by self-tapping screws.

12. A roof as set forth in claim 11 wherein the roofing is secured to the webs.

13. A roof as set forth in claim 12 wherein the roofing is corrugated sheet metal roofing fastened to the webs by self-tapping screws.

14. A roof as set forth in claim 6 wherein the trusses are sheet metal trusses and the webs are secured thereto.

15. A roof as set forth in claim 14 wherein the webs are fastened to the trusses by self-tapping screws.

16. Bracing for application extending lengthwise of the junction of two dihedral roof surfaces where they meet at a dihedral angle determined by trusses in a roof framing system, said bracing comprising a strip of about 16 gauge sheet metal formed with a longitudinally extending web and a flange extending from the web at a longitudinally extending edge of the web, the flange and web of the bracing meeting at said edge at a predetermined angle, the web being bendable in the field at said edge to different angles relative to the flange, wherein each brace is formed with a lip on a free edge of its flange extending over the web of the brace and stiffening the brace, said bracing being adapted for receiving roofing sections and providing support and rigidity against loads applied to such roofing sections, said bracing being applicable to said junction for generally flatwise engagement of the web with said trusses and securement of the web to the trusses.

* * * * *